US008365640B2

(12) United States Patent
Hsieh

(10) Patent No.: US 8,365,640 B2
(45) Date of Patent: Feb. 5, 2013

(54) ANTI-SLIP WRENCH

(76) Inventor: Chih-Ching Hsieh, Taichung Hsien (TW)

( * ) Notice: Subject to any disclaimer, the term of this patent is extended or adjusted under 35 U.S.C. 154(b) by 399 days.

(21) Appl. No.: 12/701,894

(22) Filed: Feb. 8, 2010

(65) Prior Publication Data

US 2011/0192260 A1 Aug. 11, 2011

(51) Int. Cl.

| | |
|---|---|
| ***B25B 13/02*** | (2006.01) |
| ***B25B 13/00*** | (2006.01) |
| ***B25B 23/157*** | (2006.01) |
| ***B25B 17/00*** | (2006.01) |
| ***B67B 7/14*** | (2006.01) |
| ***B67B 7/18*** | (2006.01) |
| ***B67B 7/00*** | (2006.01) |
| ***B67B 7/04*** | (2006.01) |

(52) U.S. Cl. ..... 81/119; 81/125; 81/125.1; 81/186; 81/124.2; 81/124.4; 81/3.4; 81/3.41; 81/3.49; 81/475; 81/57.32

(58) Field of Classification Search ..... 81/3.07, 81/3.09, 119, 124.2, 124.4, 125, 186; 15/159.1
See application file for complete search history.

(56) References Cited

U.S. PATENT DOCUMENTS

| | | | | |
|---|---|---|---|---|
| 5,692,265 | A * | 12/1997 | Dalury | 16/430 |
| 6,298,516 | B1 * | 10/2001 | Beals et al. | 15/143.1 |
| 2004/0255724 | A1 * | 12/2004 | Lin | 81/60 |

FOREIGN PATENT DOCUMENTS

| | | |
|---|---|---|
| TW | D116658 | 5/2007 |

* cited by examiner

*Primary Examiner* — Monica Carter
*Assistant Examiner* — Danny Hong
(74) *Attorney, Agent, or Firm* — Guice Patents PLLC

(57) ABSTRACT

An anti-slip wrench includes a handle having two opposite grip surfaces, and at least one slant slot formed on at least one of the grip surfaces of the handle. The slant slot is through the grip surface from one lateral surface of the handle to the other. The slant slot is a concave surface with two side edges, which meet the grip surface respectively. The slant slot is positioned at an included angle located between a slot axis of the slant slot and a longitudinal axis of the handle. The concave surface of the slant slot accommodates a thumb of a user when gripping the handle. The slant slot on the handle is provided to prevent the thumb from sliding longitudinally and transversely when gripping the handle.

20 Claims, 14 Drawing Sheets

ANTI-SLIP WRENCH

BACKGROUND

1 Field of the Invention

The present invention relates generally to a wrench, and is more specifically related to an anti-slip wrench with simple structure and easy manipulation 2. Background of the Invention For manipulating of a conventional wrench, it is necessary to press the surface of the handle with the thumb while holding the handle of the wrench with the palm. Generally, thumb will slide easily along the longitudinal or further transverse direction of the handle, if the friction between thumb and the surface is not sufficient. Furthermore, how the manipulation of the conventional wrench goes usually depends on conditions of the user's hands, for example, oily or sweated hands could not work properly upon the wrench.

A design patent application no. D116658, filed in Taiwan, R.O.C., entitled "Wrench (I)" discloses a wrench, which is formed of two recesses at two ends of a handle thereof, for easy manipulation. The recesses offer the placements for the thumb though, the longitudinal slid between thumb and the recesses, which results in the failure of concentrative application of the force, still happens.

In addition, a solution to the slippery-proof problem for the conventional wrench is to coat a baked anti-slip painted finish or to add extra elements on it. However, adding the coating process or making extra elements may cause the increase the primary costs due to extra materials, structures or process steps, also may bring about a change to production or prolong the manufacture period so as to result in competition weakening of enterprises.

SUMMARY OF THE INVENTION

A primary object of the present invention is to provide an anti-slip wrench with simple structure, which has at least one slant slot formed thereon for touch. Thumb of the user could press upon the slant slot, which not only prevents thumb sliding longitudinally and transversely therefrom but also serves the concentrations of the application of the force; so that the applying force is exerted for effect.

Another object of the present invention is to provide an anti-slip wrench having at least one slant slot formed thereon for touch. The slant slot is a concave surface curved to a predetermined depth, within which the thumb presses stably and ergonomically.

Another object of the present invention is to provide an anti-slip wrench having at least one slant slot formed on each grip surface of a handle thereof. Particularly, the wrench would adapt for either left-handed or right-handed users.

Another object of the present invention is to provide an anti-slip wrench having at least one slant slot formed thereon, which is provided with both functions of slippery proof and light weight. The present light wrench offers deft manipulations to consumers, and budget materials to manufacturers because of the elimination of material waste.

Another object of the present invention is to provide an anti-slip wrench having at least one slant slot formed thereon. The present wrench offers the easy-grasp design to consumers, and reduces the primary cost and process variables to manufacturers for strengthening the competition of the enterprises.

According to primary aspect of the present invention, an anti-slip wrench including a handle and at least one slant slot. The handle has two grip surfaces in an opposite manner for the upper and lower correspondence, two lateral surfaces in an opposite manner for the left and right, and an operation portion being at least one end of the handle. The slant slot is formed on at least one of the grip surfaces of the handle, and being through the grip surface from one lateral surface of the handle to the other one. The slant slot is a concave surface with two side edges, which parallel to each other and meet the grip surface respectively.

The slant slot inclines at an included angle, which is defined between a slot axis of the slant slot and a longitudinal direction of the handle. While the thumb presses over the whole slant slot, the concave surface fits the front part of thumb with fingerprint on it, and the side edges respectively abut against the flanks of thumb. Due to the reaction force generated by both sides of the slant slot, the advantage of preventing the thumb sliding longitudinally and transversely is achieved.

The user contacts the concave surface of the slant slot with the thumb, and the slant slot further provides the function of concentrating the application of the force in order to exert for effect.

The predetermined depth of the concave surface, within which the thumb is able to press stably and steadily, complies with ergonomics. Without excessive depth, the concave surface guarantees to fit the front part of thumb and to protect the tip of thumb from getting hurt.

Furthermore, plural slant slots arranged on two opposite grip surfaces of the handle is benefit either left-handed or right-handed manipulation. Especially, the wrench with the operation portion and the handle leveled on the same horizontal surface suits both right-handed and left-handed users.

With the design of plural slant slots cutting off the handle, slippery proof is functioned thereby. The wrench is also light enough for deft manipulations to consumers and for budget production to manufacturers.

Moreover, the structure of the present anti-slip wrench is simple. To consumers, the anti-slip wrench could be grasped easily and conveniently. To manufactures, the anti-slip wrench reduces the primary cost and process variables, without increasing structures, materials and complicated process, so as to strengthen the competition of the enterprises.

BRIEF DESCRIPTION OF THE DRAWINGS

These and other objects and advantages of the present invention will be more readily apparent after consideration of the following description in conjunction with the drawings.

DETAILED DESCRIPTION OF PREFERRED EMBODIMENTS

The preferred embodiments of the present invention will be described with reference to the accompanying drawings.

Figure 1:
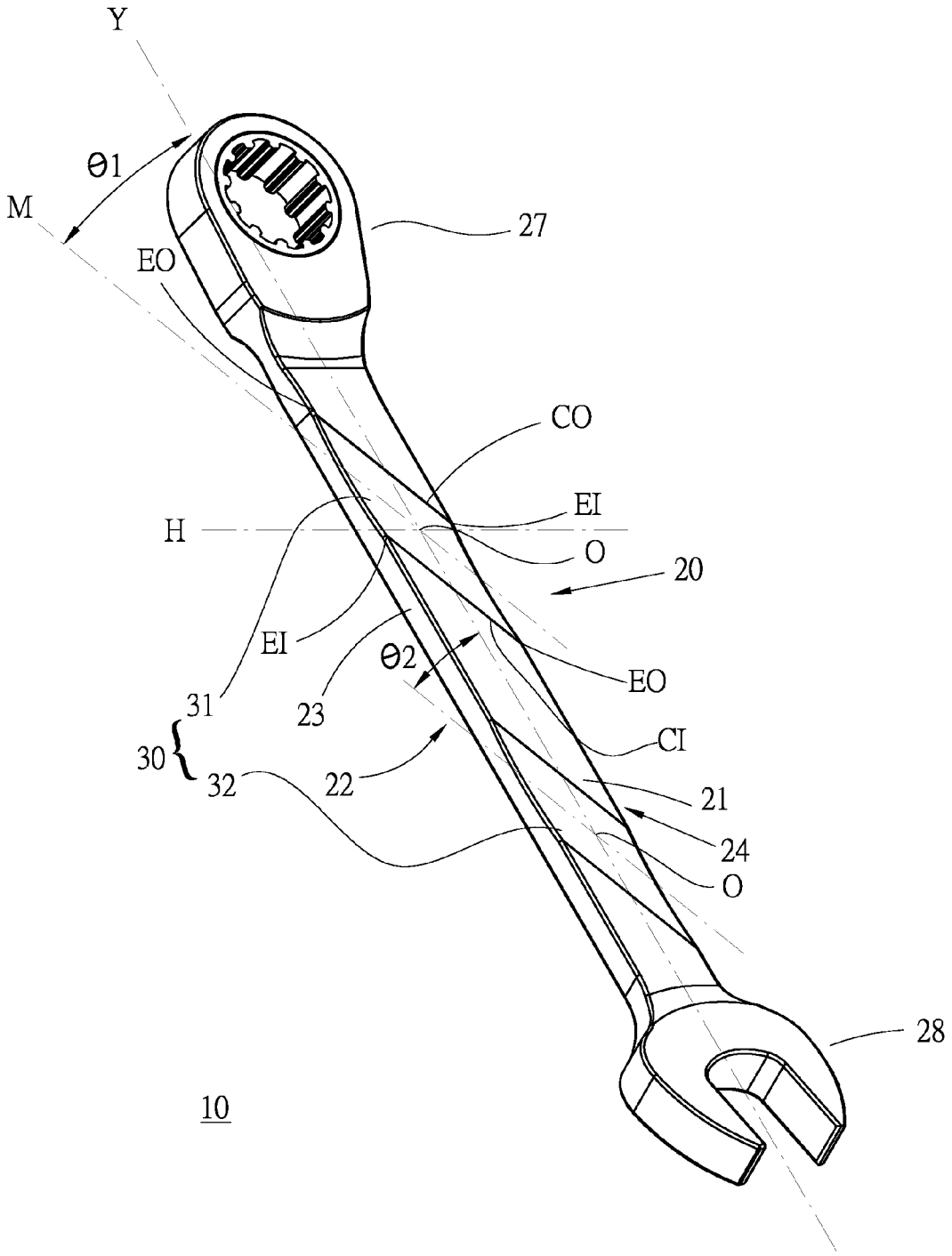
FIG. 1 is a perspective view illustrating an anti-slip wrench of a first preferred embodiment according to the present invention.

An anti-slip wrench 10 according to the present invention possessed with simple-structure and easy-manipulation functions, illustrated in FIG. 1, includes a handle 20, and at least one slant slot 30 formed on at least one grip surface of the handle 20.

Generically speaking, the handle 20 is an elongated shank being approximately flat. The handle 20 has two grip surfaces in an opposite manner for the upper and lower correspondence, two lateral surfaces in an opposite manner for the left and right, two ends connecting the two grip surface and the two lateral surfaces respectively for enclosure, and an operation portion being at least one end of the handle 20.

The slant slot 30 is formed on the grip surface of the handle, through the grip surface from one lateral surface of the handle to the other one. The slant slot 30 is a concave surface C, varied gradually with little curvatures and curved to a predetermined depth, to which no more or no less depth allows the front part of the thumb fits stably and ergonomically.

The slant slot 30 inclines at an included angle, which is defined between a slot axis M of the slant slot 30 and a longitudinal direction Y of the handle 20. The included angle is set by orientating at a center point of the slant slot 30, basing along the longitudinal direction Y of the handle 20, and rotating counterclockwise to the slot axis M of the slant slot 30. The included angle spaces from about 15° to about 75° or from about 105° to about 165°, and the preferred range of the included angles are approximately 30° to 60° and 120° to 150°.

Figure 2:
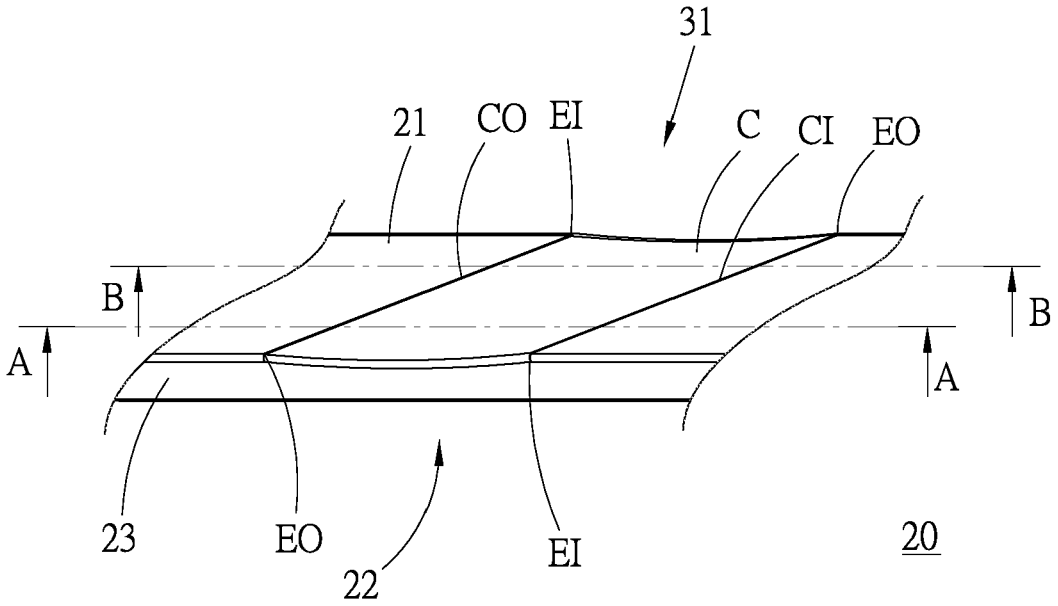
FIG. 2 is a partial perspective view in accordance with FIG. 1.

Please also referring to FIG. 2, the slant slot 30 has two opposite side edges, which respectively extends along the concave surface C to meet the respective grip surface of the handle 20. The two side edges of the slant slot 30 are approximately parallel to each other. One side edge is defined as an internal side edge CI, which is close to the middle of the handle 20; the other one, compared with the internal side edge CI, is defined as an external side edge CO that is away from the middle of the handle 20.

The distance, spacing from the external side edge CO to the internal side edge CI, is considered as a width of the slant slot 30, which would be shorter than about a knuckle length of thumb. The slant slot 30 thereby could approximately fit the front part of thumb so that thumb is able to conformable to the slant slot 30 all over from the two side edges CO, CI to the concave surface C. The both side edges CO, CI are boundary lines between the concave surface C of the slant slot 30 and the grip surface of the handle 20, and each provides the reaction force back to the thumb while in use to avert the longitudinal and transverse slide. Besides, each side edge CO/CI is provided with two extreme ends; one is defined as an external end EO far from a center point O of the slant slot 30, and the other one is defined as an internal end EI close to the center point O of the slant 30. The preferred embodiment to the included angles is implemented by that the two internal ends EI of the two side edges CO, CI approach to a slot-center horizontal line H transversely crossing of the handle 20, which means the two internal ends EI approach to the same line that goes through the handle 20 horizontally. Thus, the abutment area between the thumb and each side edge CO/CI would be more stable at the moment, the reaction force and the slippery proof function for the user would be better thereby.

In accordance to the first preferred embodiment illustrated in FIG. 1, the handle 20 of the anti-slip wrench 10 is elongated. The handle 20 is defined with an upper grip surface 21, a lower grip surface 22, a left lateral surface 23, a right lateral surface 24, a first operation portion 27 arranged at an end thereof, and a second operation portion 28 arranged at the other end thereof. The at least one slant slot 30 can include first and second slant slots 31, 32 formed on the upper grip surface 21 of the handle 20 at the same time.

For further details, the first and second slant slots 31, 32 are dented on the upper grip surface 21 of the handle 20, and go through from the left lateral surface 23 to the right lateral surface 24 thereof. The first and second slant slots 31, 32 come into approximately the same configuration and provide the included angles θ1, θ2 respectively.

Figure 2A:
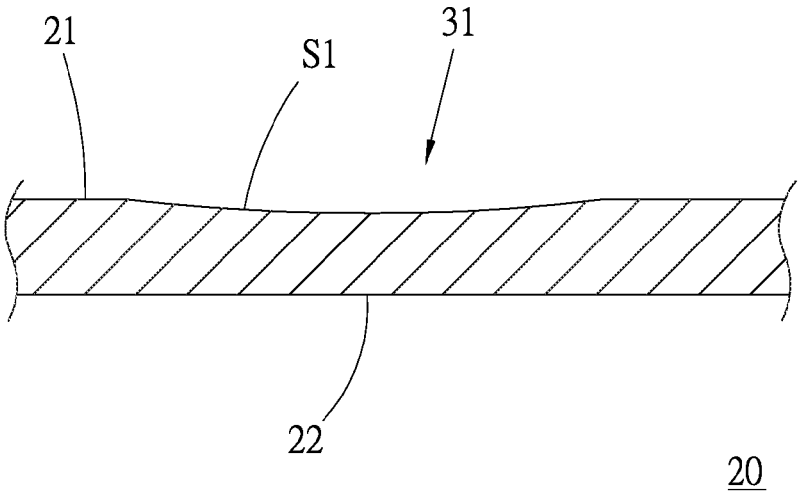
FIGS. 2A and 2B are cross-sectional profiles respectively along lines A and B in accordance with FIG. 2.
Figure 2B:
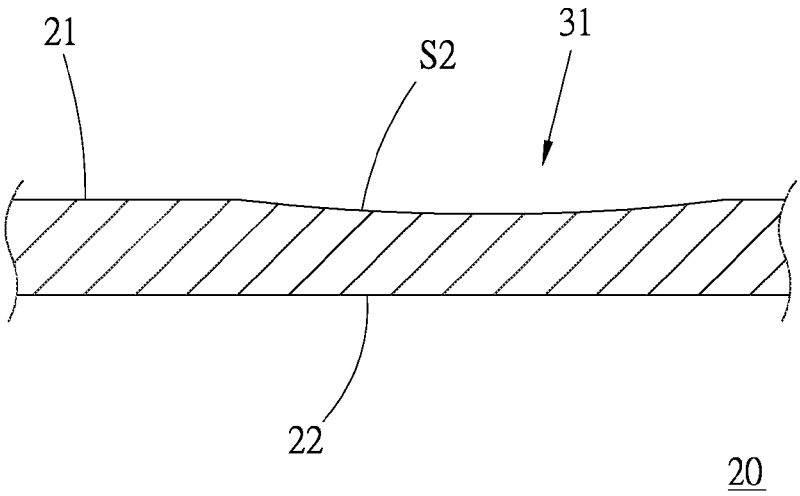

With respect to FIG. 2, the first slant slot 31, represented for all due to the approximate same configuration, is sectioned into two profiles S1, S2 by lines A, B, which are along longitudinal direction Y of the handle 20. Because the first slant slot 31 is defined together by the parallel side edges CO, CI and the concave surface C, the profiles S1, S2 would be approximately same. We can say that the profiles of the first slant slot 31 is identical cross-sectional, referring in FIGS. 2A, 2B. The concave surface C includes plural of identical sections, which overlaps to one another. The concave surface C is varied with little curvatures and curved to the predetermined depth, in which the front part of the thumb to fit. The concave surface C with the predetermined depth also provides the place where the thumb exerts stably for steady and further conforms for ergonomic manipulation. Without excessive depth, the concave surface C guarantees to fit with the front part of thumb and to protect the tip of thumb from getting hurt.

Whether and how the two operation portions 27, 28 are implemented depends on practical requirements. For example, the first operation portion 27, referred in FIG. 1, is boxed-ended or further with a ratchet; the second operation portion 28 is open-ended. Each of the two operation portions 27, 28 could level with the handle 20 on the same horizontal surface so as to suit either the right-hand or left-hand manipulation; alternatively each of the two operation portions 27, 28 could tilt or angle relatively to the horizontal surface of the handle 20 for some purposes.

With respect to FIG. 1, each slant slot 31/32 is dented for receiving the thumb; in the meanwhile, the side edges CO, CI prevent the thumb from sliding upwards and downwards. The external side edge CO, referred in FIG. 1, prevents the thumb sliding leftwards, while the internal side edge CI prevents the thumb sliding rightwards. When the user manipulates the anti-slip wrench 10 according to the present invention, the concave surface C is arranged slantwise to block the thumb from sliding along the longitudinal and transverse directions of the handle 20. Moreover, the concave surface C is capable of concentrating the application of the force as well; the applying force is exerted for effect consequently.

In accordance with this present invention, in general, the quantity of the slant slots is not restrained; the numbers of the slant slots is not limited to odd or even; the spaces between the slant slots formed on the same grip surface are not necessary to be equal; and the spaces between the slant slots formed on opposite grip surfaces are not necessary to be symmetric. Within the first embodiment, the slant slots 30 are formed merely on single grip surface of the handle 20, and the quantity of the slant slots is two. The distance spaced from each slant slot to the respective operation portion is set depending on the practical requirement and the moment balance.

With respect to FIG. 1, the two included angles θ1, θ2 of the two slant slots 31, 32 are equal as being about 30° for paralleling to each other in the first preferred embodiment. The first operation portion 27 tilts upwards to the handle 20. The slant slots 31, 32 are adjacent to the first and second operation portions 27, 28 respectively. Thus, how many conditions for manipulation are and the how much the moment needs to be balanced could be taken into consideration, and the proper one of the slant slots could be chosen for use.

Figure 3:
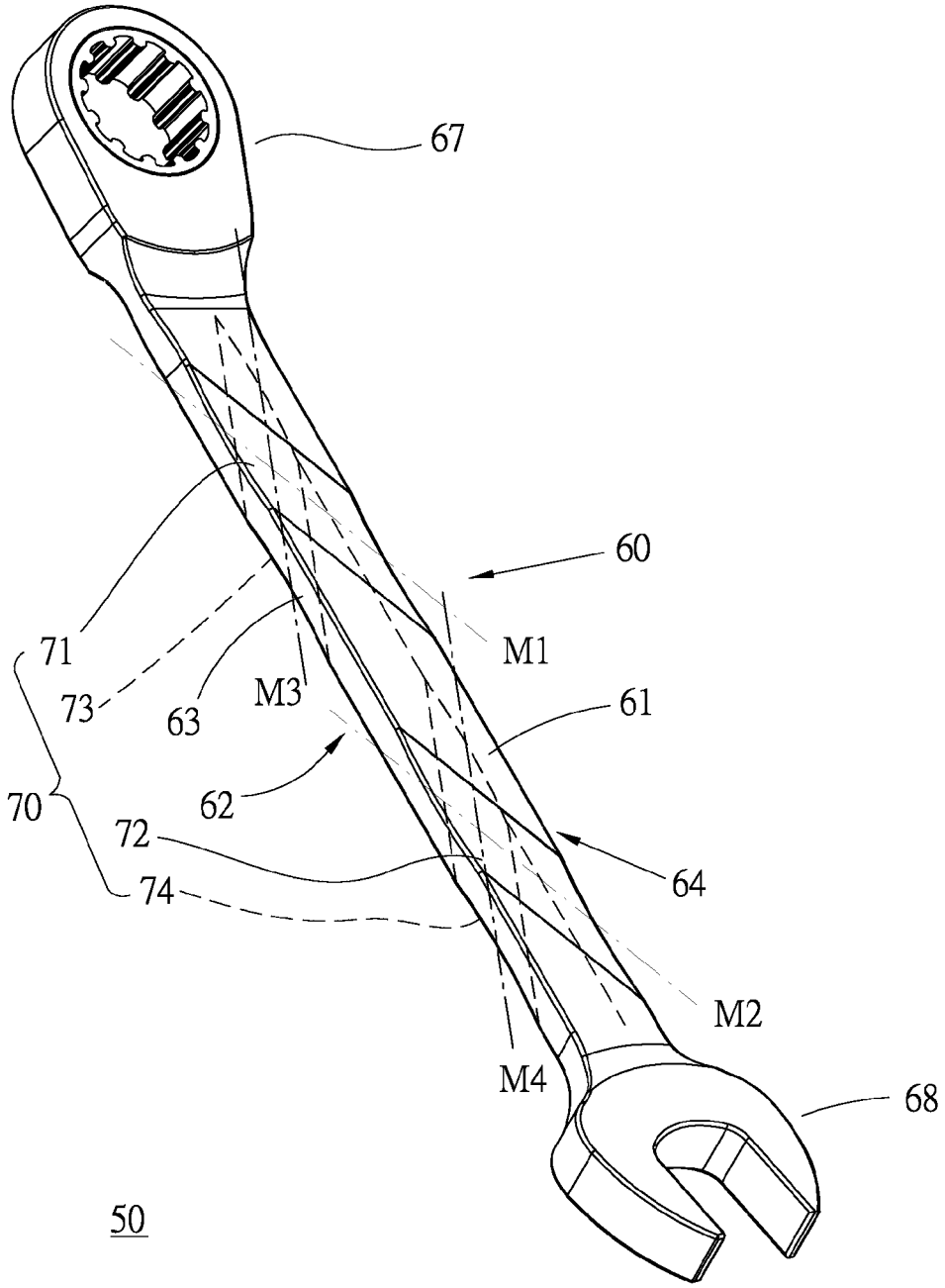
FIG. 3 is a perspective view of the anti-slip wrench according to a second preferred embodiment of the present invention.

Please refer to FIG. 3, which illustrates the second embodiment of the present invention. An anti-slip wrench 50 includes a handle 60 being elongated and a plurality of slant slots 70 formed on double grip surfaces of the handle 60. The handle 60 has an upper grip surface 61, a lower grip surface 62, a left lateral surface 63, a right lateral surface 64, a first operation portion 67 disposed at an end thereof, and a second operation portion 68 disposed at the opposite end thereof. The slant slots 70 are two upper slant slots 71, 72 and two lower slant slots 73, 74.

Figure 3A:
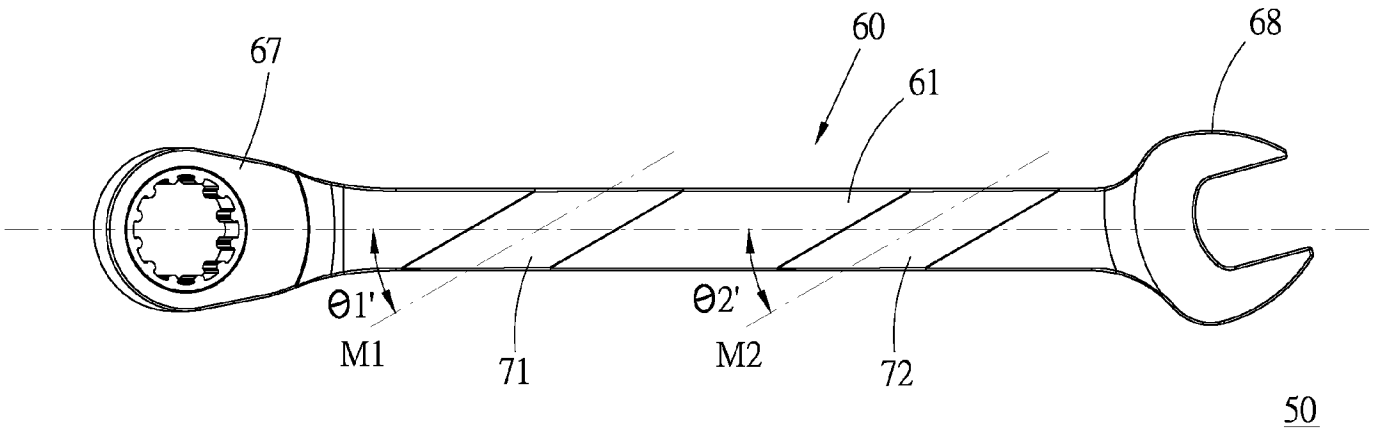
FIG. 3A is a top view in accordance with FIG. 3.
Figure 3B:
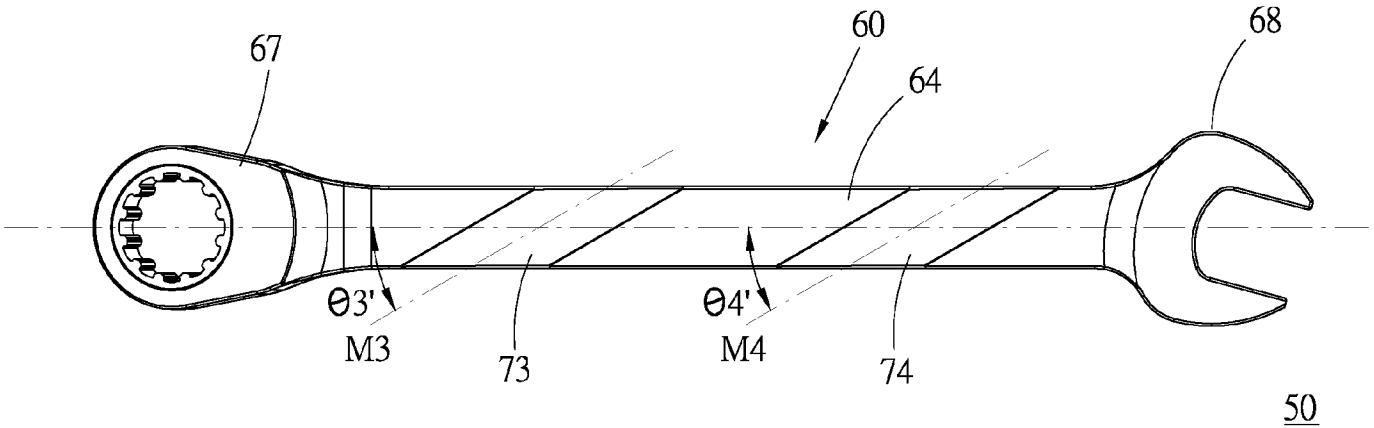
FIG. 3B is a bottom view in accordance with FIG. 3.

The top view and the bottom view of the anti-slip wrench 50 in accordance with the second preferred embodiment are illustrated in FIGS. 3A, 3B. The included angles θ1', θ2' of the two upper slant slots 71, 72 are approximately equal as being about 30° so as to parallel to each other. The included angles θ3', θ4' of the two lower slant slots 73, 74 are approximately equal as being about 30° so as to parallel to each other.

For varying embodiments, in general, the space between two upper slant slots 71, 72 is not limited to be same as that between the two lower slant slots 73, 74. The distance from each upper slant slot 71, 72 to the respective operation portion 67, 68 is not limited to be same as that from the lower slant slots 73, 74 to the respective operation portion 67, 68. In addition, each included angle θ1', θ2' of the respective upper slant slot 71, 72 is not limited to be same as that angle θ3', θ4' of the respective lower slant slots 73, 74; which means the slot axis M1 of the upper slant slot 71 is not limited to be the same direction as that slot axis M3 of the lower slant slot 73, the slot axis M2 of the upper slant slot 72 is not limited to be the same direction as that slot axis M4 of the lower slant slot 74.

Please refer to the second embodiment, the slant slots 70 are formed on double grip surfaces 61, 62 of the handle 60. The space between the two upper slant slots 71, 72 is same as that between the two lower slant slots 73, 74; the distance spacing to the respective operation portion 67, 68 of each upper slant slot 71, 72 is same as that of each lower slant slot 73, 74.

Figure 3C:
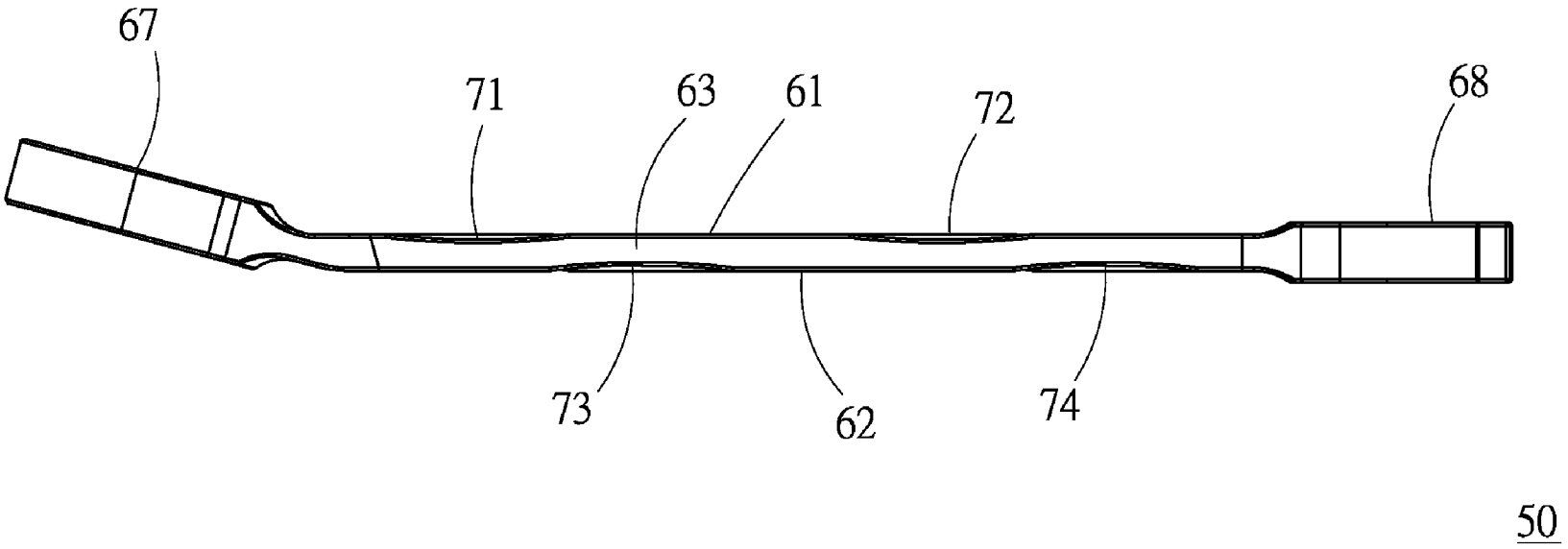
FIG. 3C is a side view in accordance with FIG. 3.

With respect to FIGS. 3A, 3B, the slot axis M1 of the upper slant slot 71 come intersecting with the slot axis M3 of the lower slant slot 73; the slot axis M2 of the upper slant slot 72 come intersecting with the slot axis M4 of the lower slant slot 74. Therefore, the upper slant slot 71 partially overlaps the lower slant slot 73; the upper slant slot 72 partially overlaps the lower slant slot 74, referring in FIGS. 3 and 3C.

To conclude, the arrangement of the slant slots on each grip surface 61, 62 is not limited to be the same, such as the quantity, the spaces among them on the same grip surface, the distances between each slant slot and the respective operation portion, and directions of the slot axes. The embodiments could come into the variety according to the present invention.

Figure 4:
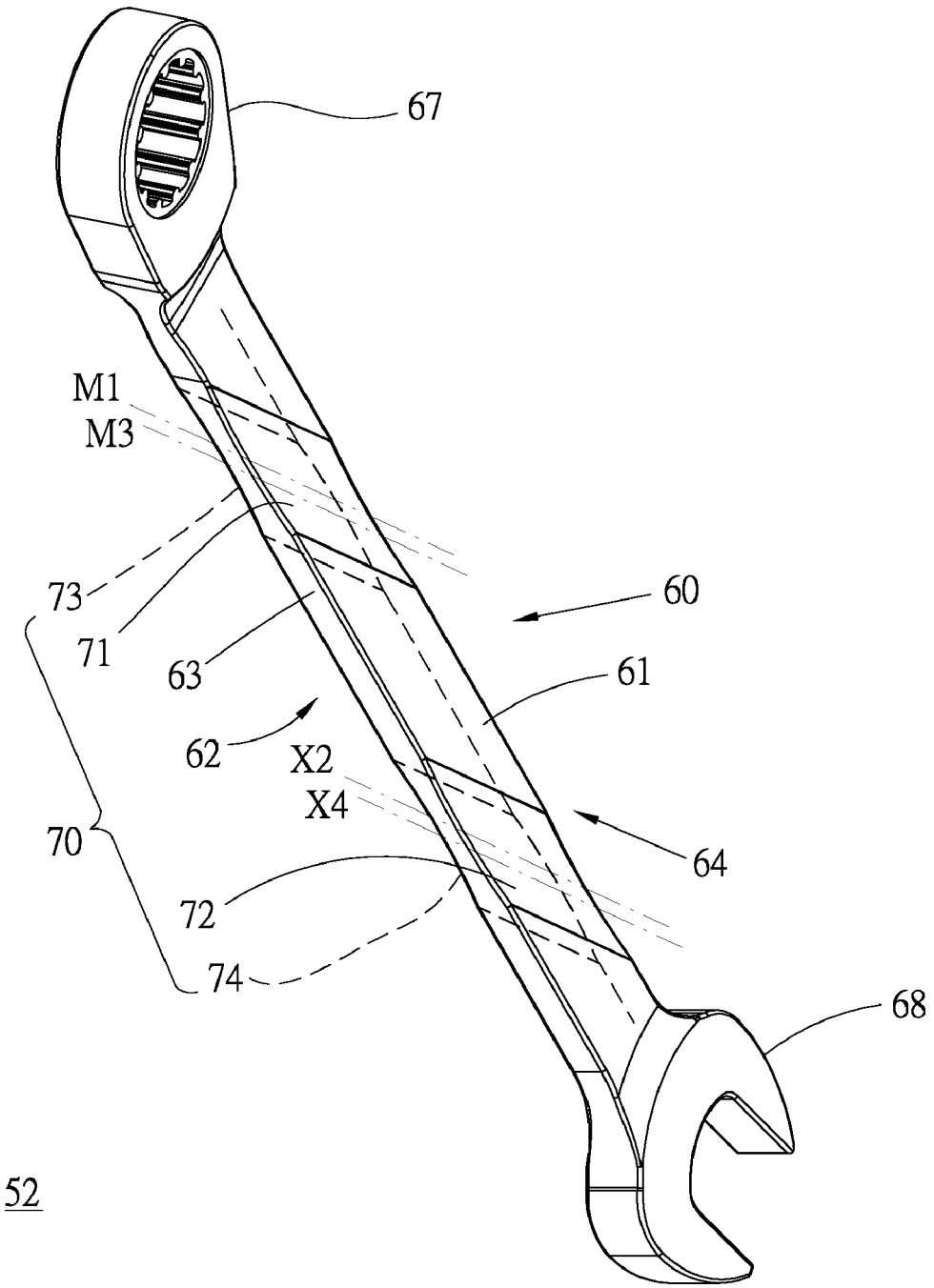
FIG. 4 is a perspective view of the anti-slip wrench according to a third preferred embodiment of the present invention.

Now referring in FIG. 4, the third embodiment according to the present invention is an anti-slip wrench 52, in which the slant slots 70 are formed on double grip surfaces 61, 62 of the handle 60 and the quantity arrangement of the slant slots 70 is same as that in the second embodiment. However, the direction of the slot axis M1 of the upper slant slot 71 is same with that of the slot axis M3 of the lower slant slot 73, while the direction of the slot axis M2 of the upper slant slot 72 is same with that of the slot axis M4 of the lower slant slot 74. Therefore, the upper slant slot 71 completely overlaps the lower slant slot 73; the upper slant slot 72 completely overlaps the lower slant slot 74.

Figure 5:
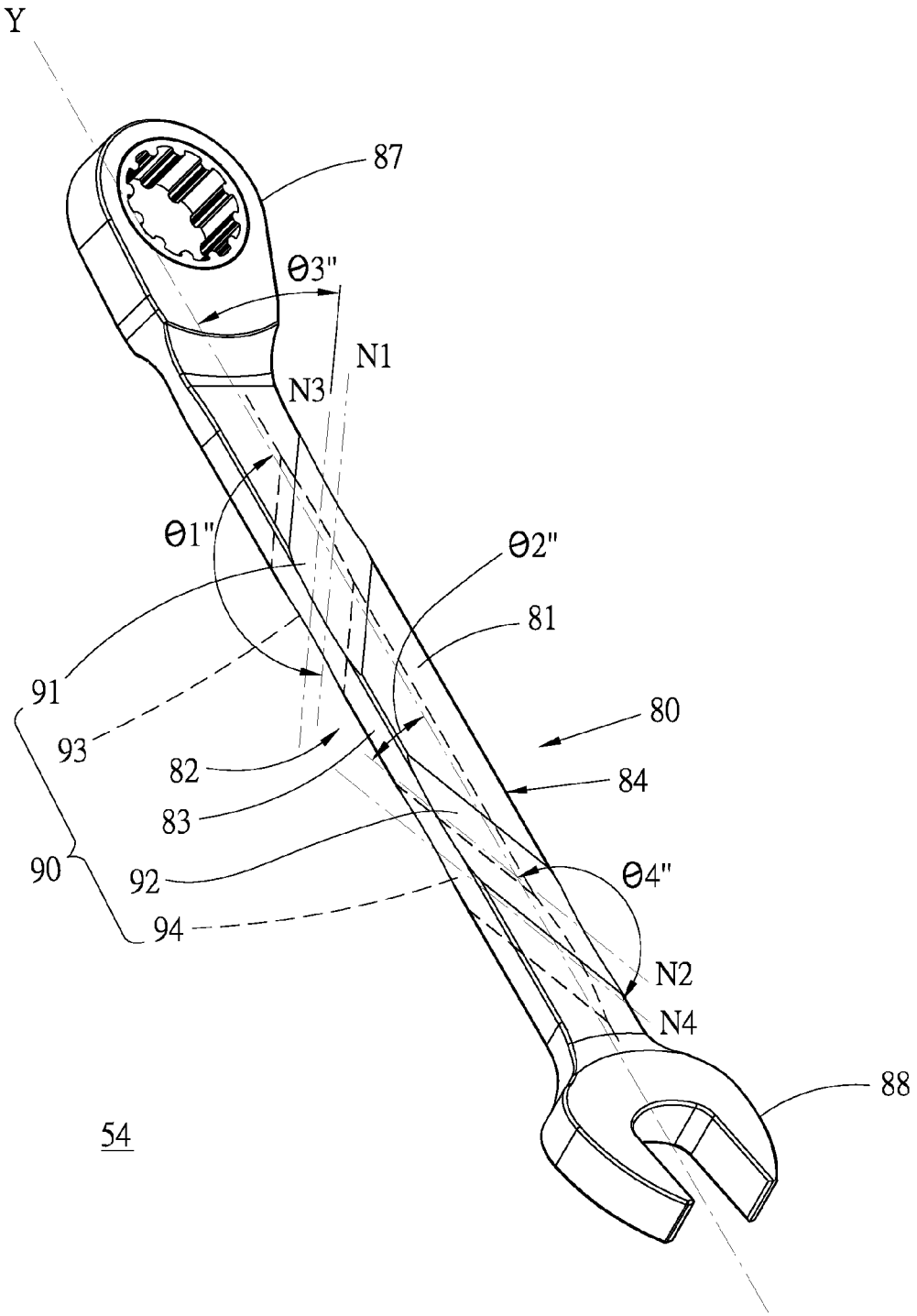
FIG. 5 is a perspective view of the anti-slip wrench according to a fourth preferred embodiment of the present invention.

Please refer to FIG. 5, which illustrates the fourth embodiment of the present invention. An anti-slip wrench 54 includes a handle 80 being elongated and a plurality of slant slots 90 formed on double grip surfaces of the handle 80. The handle 80 has an upper grip surface 81, a lower grip surface 82, a left lateral surface 83, a right lateral surface 84, a first operation portion 87 disposed at an end thereof, and a second operation portion 88 disposed at the opposite end thereof. The slant slots 90 are two upper slant slots 91, 92 and two lower slant slots 93, 94, which are through form the left lateral surface 83 to the right lateral surface 84.

Figure 5A:
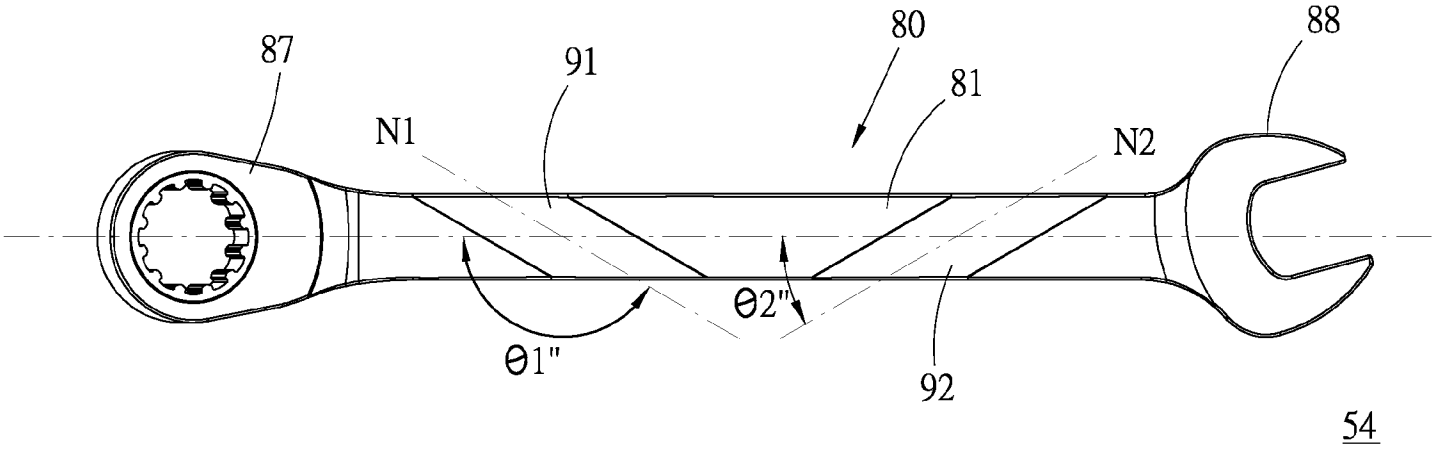
FIG. 5A is a top view in accordance with FIG. 5.
Figure 5B:
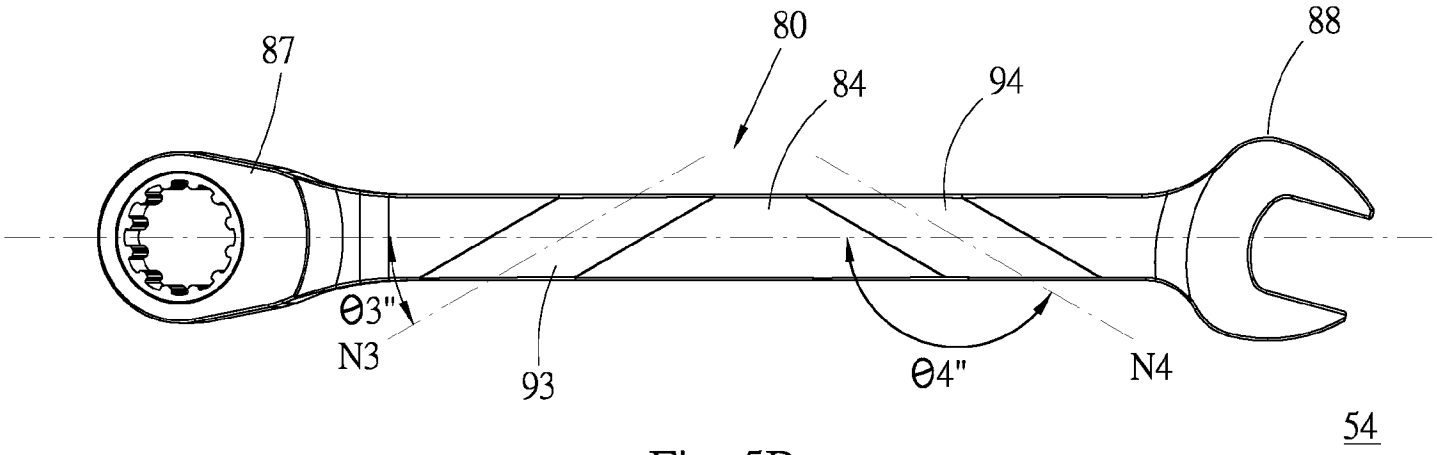
FIG. 5B is a bottom view in accordance with FIG. 5.

The top view and the bottom view of the anti-slip wrench 54 in accordance with the fourth preferred embodiment are illustrated in FIGS. 5A, 5B. The included angles θ1", θ2" of the two upper slant slots 91, 92 are approximately complementary to each other for symmetry. The included angle θ1" of the upper slant slot 91 is about 150°, while the included angle θ2" of the upper slant slot 92 is about 30°, referred in FIG. 5A. In the meanwhile, the included angles θ3", θ4" of the two lower slant slots 93, 94 are approximately complementary to each other for symmetry. The included angle θ3" of the lower slant slot 93 is about 30°, while the included angle θ4" of the lower slant slot 94 is about 150°, referred in FIG. 5B.

For varying embodiments, in general, the space between two upper slant slots 91, 92 is not limited to be same as that between the two lower slant slots 93, 94. The distance from each upper slant slot 91, 92 to the respective operation portion 87, 88 is not limited to be same as that from the lower slant slots 93, 94 to the respective operation portion 87, 88. In addition, the included angles θ1", θ2" of the two upper slant slots 91, 92 and the included angles θ3", θ4" of the two lower slant slots 93, 94 are not limited to be complementary to each other. The slot axis N1 of the upper slant slot 91 is not limited to be the same direction as that slot axis N3 of the lower slant slot 93, while the slot axis N2 of the upper slant slot 92 is not limited to be the same direction as that slot axis N4 of the lower slant slot 94.

Please refer to the fourth embodiment in FIG. 5, the slant slots 90 are formed on double grip surfaces 81, 82 of the handle 80. The space between the two upper slant slots 91, 92 is same as that between the two lower slant slots 93, 94; the distance spacing from each upper slant slot 91, 92 to the respective operation portion 87, 88 is same as that from each lower slant slot 93, 94 to the respective operation portion 87, 88.

With respect to FIGS. 5A, 5B, showing a top view and bottom view respectively, the slot axis N1 of the upper slant slot 91 is parallel with of the slot axis N3 of the lower slant slot 93, while the slot axis N2 of the upper slant slot 92 is parallel with the slot axis N4 of the lower slant slot 94. Therefore, referring to FIG. 5, the upper slant slot 91 is located directly above the lower slant slot 93; the upper slant slot 92 is located directly above the lower slant slot 94.

To sum up, the included angles of two slant slots on the same grip surface determine whether the slant slots parallel to one another. The slot axes of two slant slots on opposite grip surfaces, which also means the included angles of two slant slots on opposite grip surfaces, determine how the slant slots overlap to one another.

Figure 6:
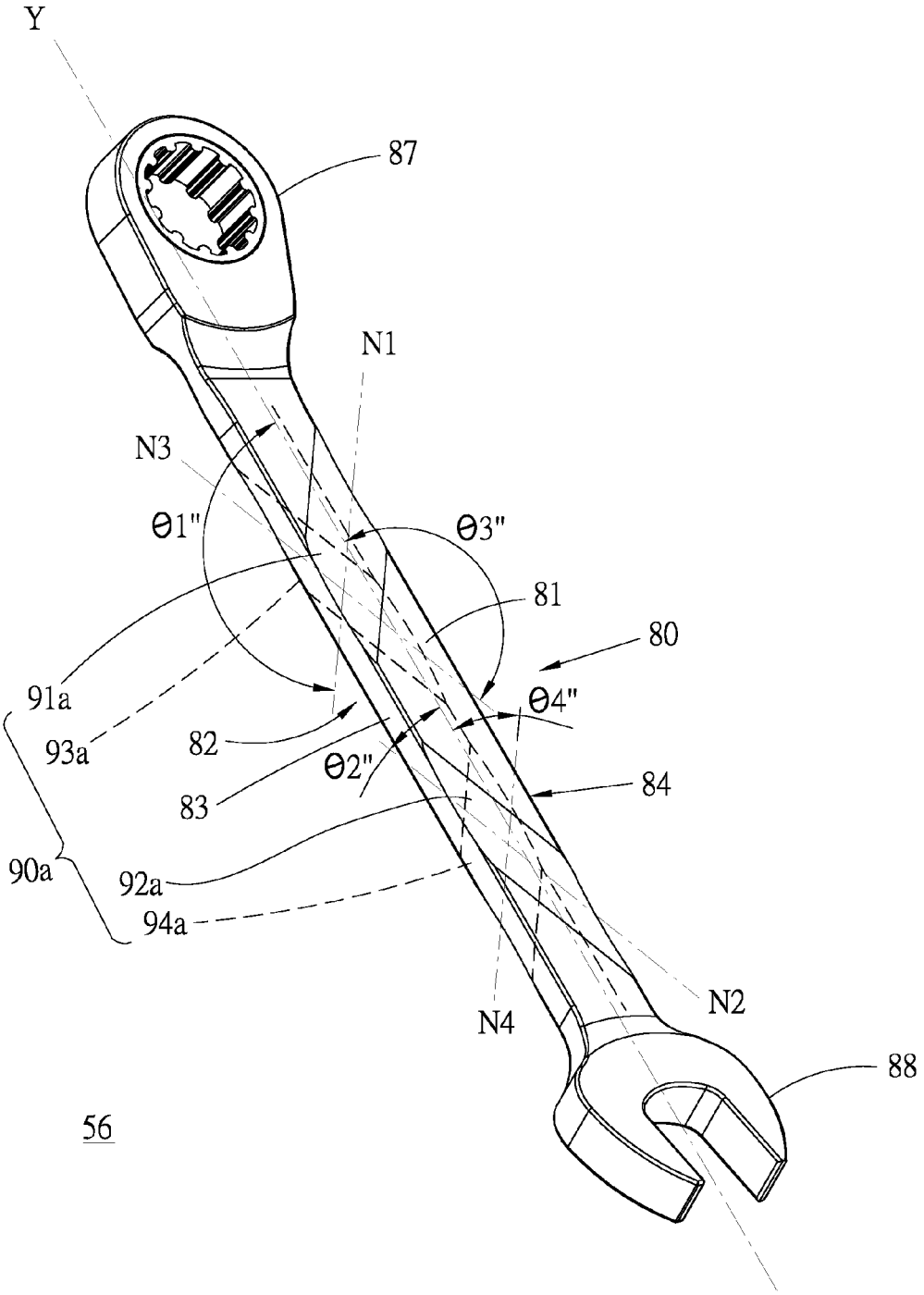
FIG. 6 is a perspective view of the anti-slip wrench according to a fifth preferred embodiment of the present invention.

Now referring in FIG. 6, the fifth embodiment according to the present invention is an anti-slip wrench 56, in which the slant slots 90*a* are formed on double grip surfaces 81, 82 of the handle 80. The included angles θ1", θ2" of the two upper slant slots 91*a*, 92*a* are approximately complementary to each other, which means the two upper slant slots 91*a*, 92*a* are symmetric. The included angle θ1" of the upper slant slot 91*a* is about 150°, while the included angle θ2" of the upper slant slot 92*a* is about 30°. In the meanwhile, the included angles θ3", θ4" of the two lower slant slots 93*a*, 94*a* are approximately complementary to each other, which means the two lower slant slots 93*a*, 94*a* are symmetric. The included angle θ3" of the lower slant slot 93*a* is about 150°, while the included angle θ4" of the lower slant slot 94*a* is about 3020 . The slot axis N1 of the upper slant slot 91*a* intersects with the slot axis N3 of the lower slant slot 93*a;* the slot axis N2 of the upper slant slot 92*a* intersects with the slot axis N4 of the lower slant slot 94*a*. Therefore, the upper slant slot 91*a* partially overlaps the lower slant slot 93*a;* the upper slant slot 92*a* partially overlaps the lower slant slot 94*a*.

Figure 7:
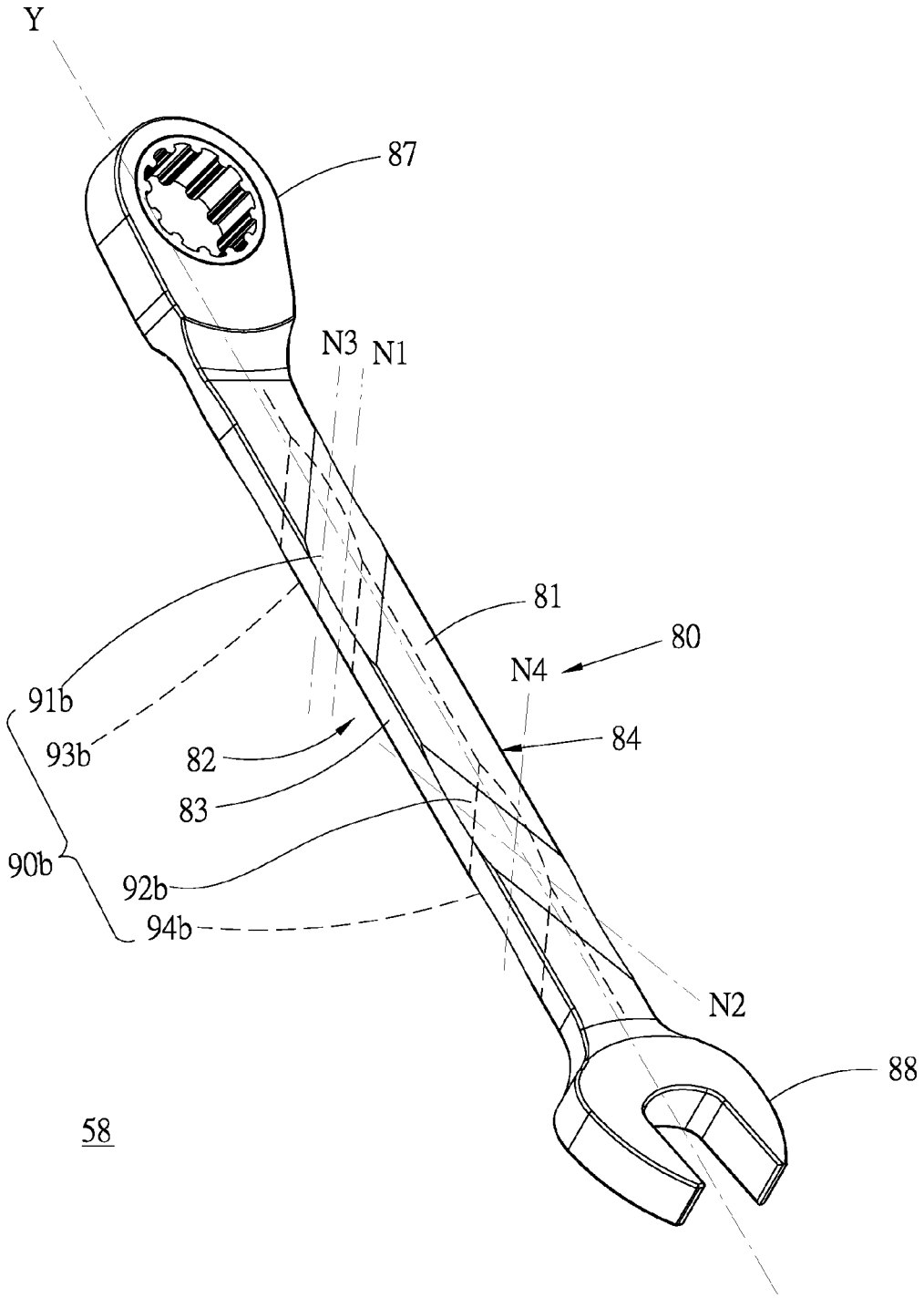
FIG. 7 is a perspective view of the anti-slip wrench according to a sixth preferred embodiment of the present invention.

Now referring in FIG. 7, the sixth embodiment according to the present invention is an anti-slip wrench 58, in which the included angles θ1", θ2" of the two upper slant slots 91*b*, 92*b* are approximately complementary to each other, which means the two upper slant slots 91*b*, 92*b* are symmetric. In the meanwhile, the included angles θ3", θ4" of the two lower slant slots 93*b*, 94*b* are approximately equal, which means the two lower slant slots 93*b*, 94*b* parallel to each other. Resulting from that the arrangements of slant slots on opposite grip surfaces are apparently different; the slot axis N1 of the upper slant slot 91*b* goes the same direction as the slot axis N3 of the lower slant slot 93*b*, and the slot axis N2 of the upper slant slot 92*b* intersects with the slot axis N4 of the lower slant slot 94*b*. Therefore, referring to FIG. 6, the upper slant slot 91*b* completely overlaps the lower slant slot 93*b;* the upper slant slot 92*b* partially overlaps the lower slant slot 94*b*.

Figure 8A:
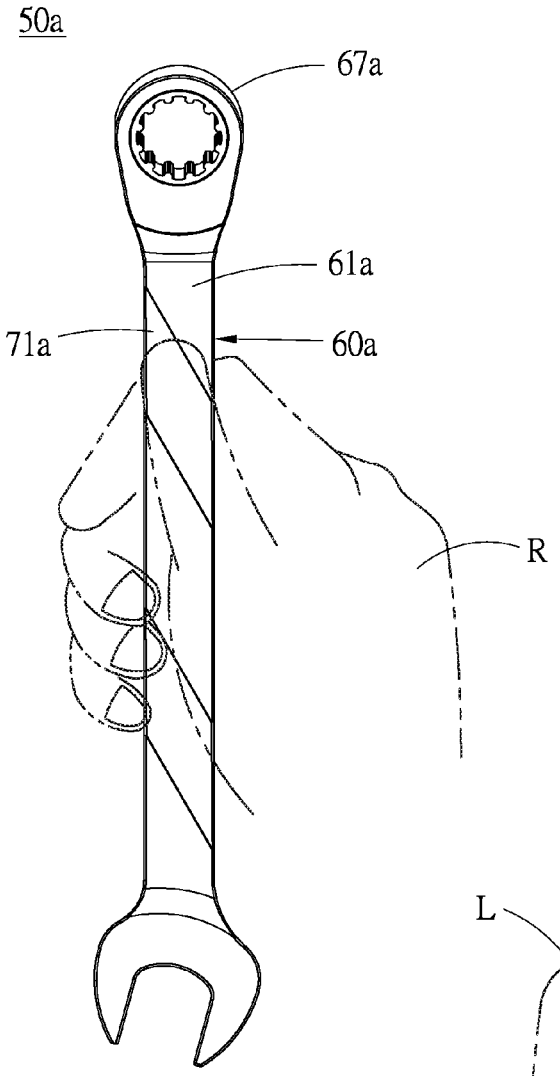
FIGS. 8A and 8B are top views respectively illustrating the right hand and the left hand manipulating the same grip surface of the anti-slip wrench.
Figure 8B:
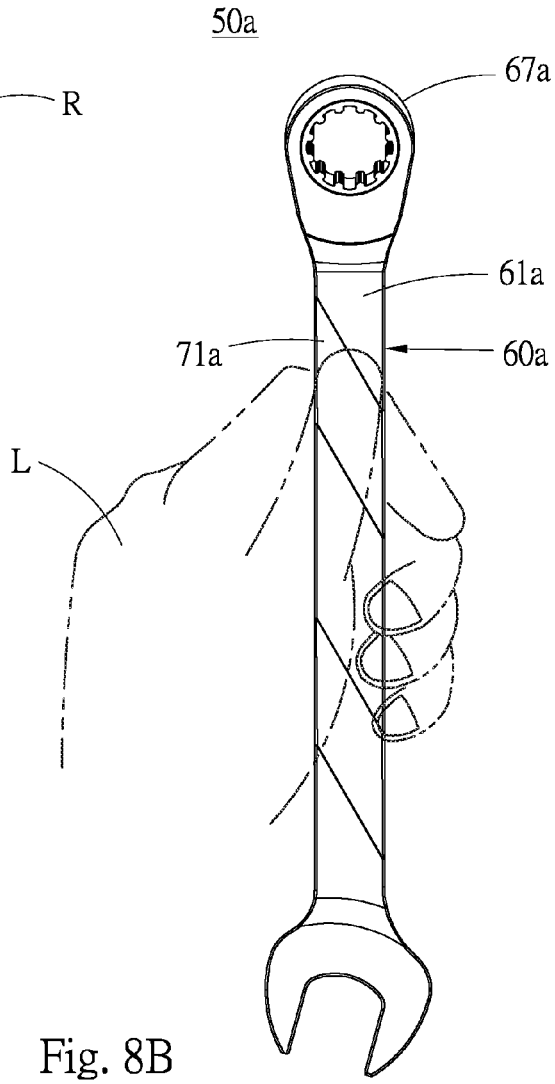
Figure 8C:
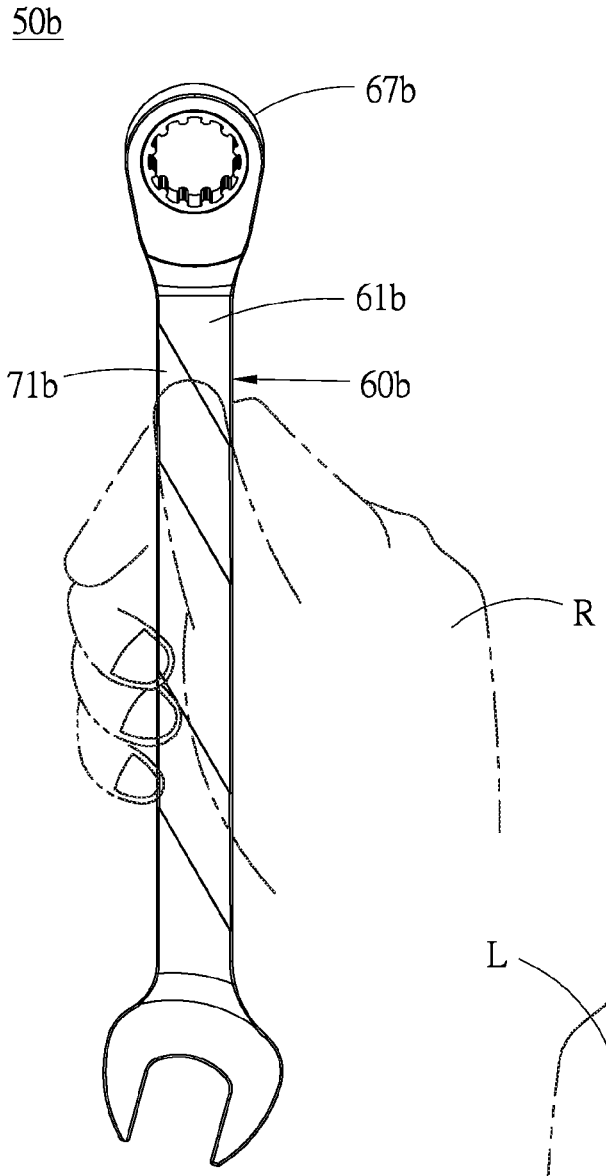
FIGS. 8C and 8D are top views respectively illustrating the right hand and the left hand manipulating the opposites grip surfaces of the anti-slip wrench.
Figure 8D:
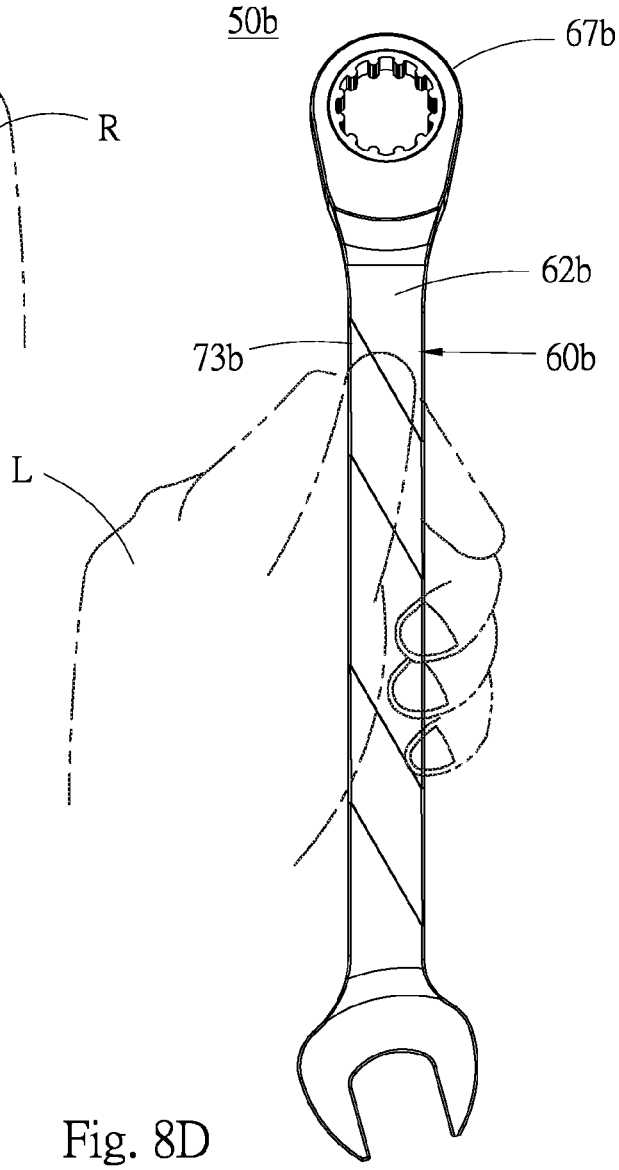

In common, the arrangements of the slant slots on the same grip surface are divided into at least parallel and symmetry. Consequently, the arrangements for opposite grip surfaces could vary in accordance with the mentioned arrangements for single grip surface, in order to achieve embodiments for slippery proof function. Particularly, when the operation portion is leveled on the same horizontal surface with the handle, the present wrench would be better to suit either right-hand or left-hand user. Further details please referring to FIG. 8A, the user holds a handle 60*a* of the present anti-slip wrench 50*a* via the right hand R. A first operation portion 67*a* is tilted to the handle 60*a*. The thumb fits an upper slant slot 71*a* of an upper grip surface 61*a* for manipulation. For the user holding the wrench 50*a* via the left hand L is referred in FIG. 8B, in which the thumb fits the upper slant slot 71*a* for manipulation. Further embodiments please referring to FIG. 8C, the user holds a handle 60*b* of the present anti-slip wrench 50*b* via the right hand R. A first operation portion 67*b* is leveled on the same horizontal surface with the handle 60*b*. The thumb fits an upper slant slot 71*b* of an upper grip surface 6 lb for manipulation. For the user holding the wrench 50*b* via the left hand L is referred in FIG. 8D, in which the thumb fits a lower slant slot 73*b* of a lower grip surface 62*b* for manipulation. Accordingly, the slippery proof function achieved by the present wrench could be manipulated by either single grip surface or double grip surfaces, either right hand or left hand.

Figure 9:
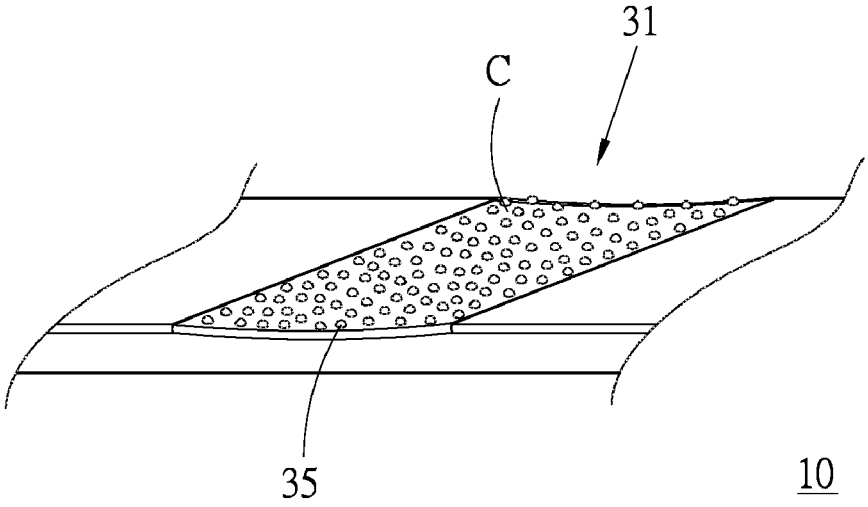
FIG. 9 is an enlarged perspective view of the anti-slip wrench according to a preferred embodiment of a slant slot.
Figure 10:
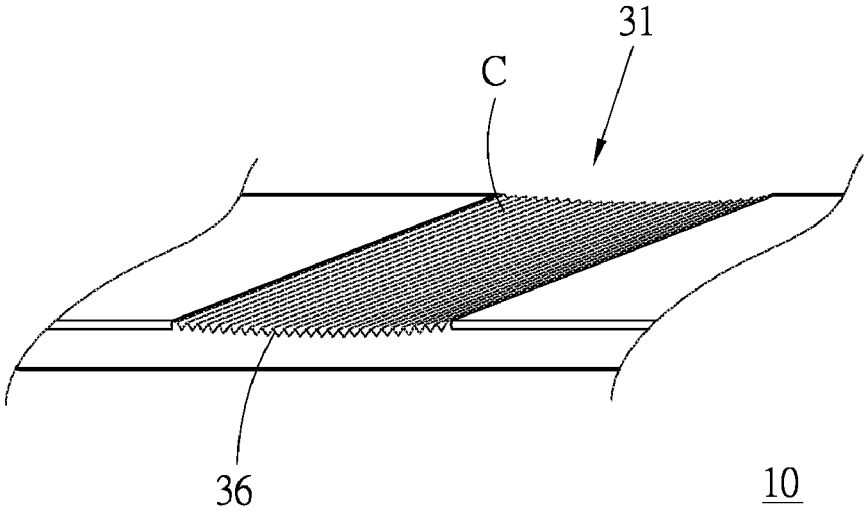
FIG. 10 is an enlarged perspective view of the anti-slip wrench according to another preferred embodiment of the slant slot.

Moreover, for increasing the friction between the slant slot and thumb, the slant slot could be processed for minor modifications. A preferred embodiment of the slant slot is illustrated in FIG. 9, in which the slant slot 31 has a plurality of protrusions 35 disposed on the concave surface C. The protrusions 35 could be arranged at random or along the longitudinal direction of the handle so as to make each profile of the concave surface C is similar but not same with one another. The implementation of the protrusions 35 is for the increase of the friction and not restrained to the protrusions 35. Another preferred embodiment of the slant slot is illustrated in FIG. 10, in which the slant slot 31 has a plurality of fine notches 36 dented on the concave surface C and paralleled to one another. The fine notches 36 could be arranged along the slot axis of the each slant slot so as to make each profile of the concave surface C looks like serrated. In another manner, the fine notches 36 could be arranged along the longitudinal direction of the handle. All the implementations on the slant slot results in making each profile of the concave surface C is similar but not same with one another.

The anti-slip wrench according to the present invention could achieve the slippery proof function by the serve of the slant slots. Besides, the anti-slip wrench also meets the light weight requests for deft manipulations to consumers, and the simple structure needs for budget production to manufacturers. In addition, the slant slot with little curvatures and curved to a predetermined depth, which the slot cutoff doesn't impact the strength of the present wrench and thumb is able to fit stably and ergonomically into. Under the conditions that keeping the primary costs and the structure strength, the process variables could be eliminated and the competition of the enterprises could be strengthened thereby without increasing structures, materials and complicated process.

The anti-slip wrench with simple structure and easy grasp according to the present invention meets the advantages of preventing thumb sliding longitudinally and transversely, which is achieved by the serve of at least one slant slot. The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An anti-slip wrench comprising:

a handle having two grip surfaces being an upper grip surface and a lower grip surface, two lateral surfaces located on opposing left and right lateral surfaces of the handle, and an operation portion located on at least one end of the handle; and two slant slots formed on at least one of the two grip surfaces of the handle, each slot of the two slant slots extending across a corresponding surface of the two grip surfaces and communicating with the left and right lateral surfaces of the handle, each slant slot being a concave surface with two side edges engaging the grip surface respectively;

wherein each slant slot is positioned at an included angle of 15 to 75 degrees or 105 to 165 degrees located between a slot axis of the slant slot and a longitudinal axis of the handle, each said slot axis of each of the two slant slots is located between two corresponding side edges.

2. The anti-slip wrench according to claim 1, wherein the two side edges of the slant slot are spaced apart a predetermined length.

3. The anti-slip wrench according to claim 1, wherein each side edge of the slant slot has two extreme ends; one is an external end far from a center point of the slant slot, and the other one is an internal end close to the center point of the slant slot; wherein two internal ends of each side edge of the slant slot approach to a slot-center horizontal line transversely crossing the handle.

4. The anti-slip wrench according to claim 1, wherein the slant slot has a plurality of fine notches parallel to one another and arranged along the concave surface thereof.

5. The anti-slip wrench according to claim 1, wherein the slant slot has a plurality of protrusions arranged on the concave surface thereof.

6. The anti-slip wrench according to claim 1, wherein a first slot axis of a first slant slot of the two slant slots is positioned at a same angle or a complementary angle relative to a second slot axis of a second slant slot of the two slant slots.

7. The anti-slip wrench according to claim 1, wherein the two slant slots formed on at least one of the two grip surfaces of the handle includes two upper slant slots located on the upper grip surface and two lower slant slots located on the lower grip surface.

8. The anti-slip wrench according to claim 7, a first upper slot axis of a first upper slant slot of the two upper slant slots is positioned at a same angle relative to a second upper slot axis of a second upper slant slot of the two upper slant slots and a first lower slot axis of a first lower slant slot of the two lower slant slots is positioned at a same angle relative to a second lower slot axis of a second lower slant slot of the two lower slant slots.

9. The anti-slip wrench according to claim 7, a first upper slot axis of a first upper slant slot of the two upper slant slots is positioned at a complementary angle relative to a second upper slot axis of a second upper slant slot of the two upper slant slots and a first lower slot axis of a first lower slant slot of the two lower slant slots is positioned at a complementary angle relative to a second lower slot axis of a second lower slant slot of the two lower slant slots.

10. An anti-slip wrench adapted for both left-handed and right-handed users comprising:

a handle having two grip surfaces being an upper grip surface and a lower grip surface, two lateral surfaces located on opposing left and right lateral surfaces of the handle, and an operation portion located on at least one end of the handle; and two slant slots, an upper slant slot of the two slant slots is located on the upper grip surface and a lower slant slot of the two slant slots is located on the lower grip surface, the two slant slots extending across a corresponding grip surface of the two grip surfaces and communicating with the left and right lateral surfaces of the handle, wherein each slant slot is a concave surface having two side edges being parallel and engaging the corresponding grip surface;

wherein each of the two slant slots is positioned at an included angle of 15 to 75 degrees or 105 to 165 degrees located between a slot axis of the respective slant slot and a longitudinal axis of the handle, each said slot axis of each of the two slant slots is located between two corresponding side edges.

11. The anti-slip wrench according to claim 10, wherein the two side edges of each slant slot are spaced apart a predetermined length.

12. The anti-slip wrench according to claim 10, wherein each side edge of each slant slot has two extreme ends; one is an external end far from a center point of the slant slot, and the other one is an internal end close to the center point of the slant slot; wherein two internal ends of each side edge of the respective slant slot approach to a slot-center horizontal line transversely crossing the handle.

13. The anti-slip wrench according to claim 10, wherein the operation portion and the handle are leveled on the same horizontal surface.

14. The anti-slip wrench according to claim 10, wherein each slant slot has a plurality of protrusions arranged on the concave surface thereof.

15. The anti-slip wrench according to claim 10, wherein each slant slot has a plurality of fine notches parallel to one another and arranged along the concave surface thereof.

16. The anti-slip wrench according to claim 10, wherein the wherein an upper slot axis of the upper slant slot is positioned at a same angle relative to a lower slot axis of the lower slant slot.

17. The anti-slip wrench according to claim 10, wherein the wherein an upper slot axis of the upper slant slot is positioned at a complimentary angle relative to a lower slot axis of the lower slant slot.

18. The anti-slip wrench according to claim 7, wherein a first upper slot axis of a first upper slant slot of the two upper slant slots is positioned at a complementary angle relative to a second upper slot axis of a second upper slant slot of the two upper slant slots and a first lower slot axis of a first lower slant slot of the two lower slant slots is positioned at a same angle relative to a second lower slot axis of a second lower slant slot of the two lower slant slots.

19. The anti-slip wrench according to claim 8, wherein two upper slot axes of the two upper slant slots are positioned at a same or a complementary angle relative to two lower slot axes of the two lower slant slots.

20. The anti-slip wrench according to claim 9, wherein two upper slot axes of the two upper slant slots are positioned at a same or a complementary angle relative to two lower slot axes of the two lower slant slots.

* * * * *